United States Patent [19]

Watanabe

[11] 4,408,781

[45] Oct. 11, 1983

[54] RECORDING MATERIALS

[75] Inventor: Shojiro Watanabe, Fujinomiya, Japan

[73] Assignee: Fuji Photo Film Co., Ltd., Kanagawa, Japan

[21] Appl. No.: 314,341

[22] Filed: Oct. 23, 1981

[30] Foreign Application Priority Data

Oct. 24, 1980 [JP] Japan ..... 55-149132
Aug. 12, 1981 [JP] Japan ..... 56-126161

[51] Int. Cl.[3] ..... B41M 5/16; B41M 5/18; B41M 5/22

[52] U.S. Cl. ..... 282/27.5; 427/150; 428/327; 428/331; 428/341; 428/342; 428/488; 428/537

[58] Field of Search ..... 282/27.5; 427/150, 151; 428/340, 341, 342, 327, 320.2, 320.4, 320.6, 320.8, 488, 331, 511–513, 537, 913, 914

[56] References Cited

U.S. PATENT DOCUMENTS 3,658,998 4/1972 Ehrhardt et al. ..... 282/27.5
4,303,548 12/1981 Shimazaki et al. ..... 282/27.5
4,321,092 3/1982 Cespon ..... 282/27.5

*Primary Examiner*—Bruce H. Hess
*Attorney, Agent, or Firm*—Sughrue, Mion, Zinn, Macpeak, and Seas

[57] ABSTRACT

A recording material is described comprising a base and a developer composition comprising (1) a phenolic compound selected from a bisphenol compound and a phenolic resin, (2) acid-treated activated clay, and (3) a polyalkylene oxide compound applied to said base.

21 Claims, No Drawings

RECORDING MATERIALS

FIELD OF THE INVENTION

The present invention relates to recording materials, and particularly to recording materials using a composition including a particular type of phenolic compound, acid-treated activated clay, and a polyalkylene oxide compound.

BACKGROUND OF THE INVENTION

Hitherto, recording materials utilizing a color reaction of a color former with a compound which forms a color upon contacting said color former (hereinafter, referred to as a developer) have been well known. Examples thereof include pressure-sensitive copying paper, heat-sensitive recording paper, and electric current sensitive recording paper, etc., which have been described in U.S. Pat. Nos. 2,712,507, 2,730,456, 2,730,457, 3,418,250, 3,432,327, 3,981,821, 3,993,831, 3,996,156, 3,996,405 and 4,000,087, etc.

In these recording materials, clay minerals such as acid clay, bentonite or kaolin, etc., phenolformaldehyde novolak, metal salt of novolak and zinc di-tert-butylsalicylate, etc., have been used as the developer.

Further, nearly colorless compounds having a partial skeleton comprising a lactone, lactam, sultone, spiropyran, ester or amide, etc., which undergo ring-cleavage or dissociation upon contact with the developer have been used as the color former. Examples thereof include Crystal Violet lactone, benzoyl Leucomethylene Blue, Malachite Green lactone, Rhodamine B lactam, 1,3,3-trimethyl-6′-ethyl-8′-butoxyindolinobenzospiropyran, and 4,4′-bisdimethylaminodiphenylmethyl-p-dodecylphenyl sulfone, etc.

These color formers are sometimes used as a combination of two or more thereof.

In the case of using developers as described above, the developing ability of the developer sheet deteriorates over a period of time when the developer sheet is allowed to remain exposed to the atmosphere. Since deterioration of the developing ability has a remarkable influence upon trade value, improvement of the developing ability stability has been desired.

Further, images on the developer layer may disappear due to influences such as organic solvent vapor, a plasticizer, etc. This drawback is one of unsuitable phenomena which are desired to be overcome.

Furthermore, when the developer layer is wetted with water while contacting a color former layer, images on the developer layer cannot be observed. This drawback is another matter with respect to which improvement is desired.

It has already been found by the present inventors that recording materials having excellent solvent resistance and excellent water resistance and which undergo less deterioration of developing ability over a period of time can be prepared by using a particular type of phenolic compound such as a bisphenol compound or a phenolic resin together with acid-treated activated clay (e.g., British Pat. No. 1,356,402).

However, though the recording materials using the bisphenol compound or phenolic resin together with the acid-treated activated clay have the above-described advantages, they have drawback in that the developer layer tends to yellow over a period of time or by exposure to sunlight or other sources of ultraviolet rays. Therefore, it is required to overcome such a drawback.

SUMMARY OF THE INVENTION

Accordingly, a first object of the present invention is to reduce yellow coloration of the developer layer. A second object is to prevent deterioration of the developing ability over a period of time. A third object is to improve solvent resistance. A fourth object is to provide recording materials having improved water resistance.

The above described objects of the present invention have been attained by using a recording material comprising (1) a phenolic compound selected from a bisphenol compound and a phenolic resin, (2) acid-treated activated clay, and (3) a polyalkylene oxide compound, as a developer composition.

DETAILED DESCRIPTION OF THE INVENTION

The bisphenol compound used according to the present invention refers to a compound wherein at least two phenol compounds are linked through an alkylene group.

Examples of raw materials for forming an alkylene bond include aldehyde-ketones, which can be used for synthesizing the bisphenol compound.

Further, in the bisphenol compounds to be used in the present invention, it is preferred that groups causing steric hindrance, such as a t-butyl, t-amyl or benzyl group, etc., not be present on the positions adjacent to the phenolic hydroxyl group (ortho position).

The above described phenol compounds may be substituted by chlorine atoms, alkyl groups having 16 or less carbon atoms, alkenyl groups, carboxyalkyl groups, and aralkyl groups, etc.

Among bisphenol compounds used in the present invention, compounds represented by formula (I) are preferred.

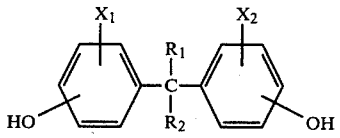

(I)

In formula (I), $R_1$ and $R_2$ can each represent a hydrogen atom or an alkyl group having 16 or less carbon atoms, and $X_1$ and $X_2$ can each represent a hydrogen atom, an alkyl group, an alkenyl group, a carboxyalkyl group, an aralkyl group, a halogen atom, a nitro group, an amino group, a hydroxyl group, or a carboxyl group.

Among bisphenol compounds represented by the above described formula (I), compounds wherein the alkylene group linking the phenolic nuclei has 8 or less carbon atoms are preferred.

Examples of typical bisphenol compounds useful in the present invention include: 2,2-bis(4′-hydroxyphenyl)propane, 2,2-bis(4′-hydroxyphenyl)butane, 2,2-bis(4-hydroxyphenyl)pentane, 2,2-bis(4′-hydroxy-3′,5′-dichlorophenyl)propane, 1,1-bis(4′-hydroxyphenyl)cyclohexane, 2,2-bis(4′-hydroxyphenyl)hexane, 1,1-bis(4′-hydroxyphenyl)propane, 1,1-bis(4′-hydroxyphenyl)butane, 1,1-bis(4′-hydroxyphenyl)pentane, 1,1-bis(4′-hydroxyphenyl)hexane, 1,1-bis(4′-hydroxyphenyl)heptane, 1,1-bis(4′-hydroxyphenyl)octane, 1,1-bis(4′-hydroxyphenyl)-2-methyl-pentane, 1,1-bis(4-hydroxyphenyl)-2-ethyl-hexane, 1,1-bis(4'-hydroxyphenyl)dodecane, 2,2-methylenebis-4-chlorophenol and 2,2-bis(4-hydroxyphenyl)hexafluoropropane, etc.

Particularly preferred examples thereof include 2,2-bis(4'-hydroxyphenyl)butane and 2,2-bis(4'-hydroxyphenyl)propane (bisphenol A). These bisphenol compounds may be used as a combination of two or more thereof.

The phenolic resin to be used in the present invention is that which has been known as the so-called novolak resin, examples of which include p-phenylphenol resin, p-tert-butylphenol resin, p-octylphenol resin, p-nonylphenol resin, p-chlorophenol resin, p-cumylphenol resin and metal salts thereof. However, p-phenylphenol resin is particularly preferred because it has a high developing ability.

Examples of the activated clay useful in the present invention include montmorillonite clay and bentonite clay which are subjected to acid-treatment.

In the present invention, the phenolic compound is preferably used in an amount of from 2 to 50 wt%, and more preferably from 5 to 30 wt%, based on the weight of the acid-treated activated clay.

The polyalkylene oxide compound in the present invention is a polymer of one or more kinds of alkylene oxide.

Although the useful alkylene oxides are not limited, those having 2 to 8 carbon atoms are preferred. Particularly, ethylene oxide and propylene oxide are preferred.

It is preferred that the polyalkylene oxide has a molecular weight of from 200 to 5,000, and preferably from 300 to 1,000.

The polyalkylene oxide compound is added in an amount of from 0.2 to 5 wt%, and preferably 1 to 3 wt%, based on the weight of the acid-treated activated clay. If the amount is less than 0.2 wt%, the effect of preventing yellow coloration is hardly observed. If it is above 5 wt%, the developing ability deteriorates.

In order to produce the developer composition in the present invention, it is necessary to process the above described phenolic compounds by means of a dispersing apparatus.

In carrying out the dispersing of the phenolic compound, it is advantageous from the viewpoint of prevention of aggregation and improvement of developing ability to add the above described acid-treated activated clay and a magnesium compound such as magnesium carbonate, magnesium hydroxide, or magnesium oxide, etc., to the phenolic compound.

A preferred amount of the magnesium compound is from 1 to 6 wt% based on the weight of acid-treated activated clay.

Although the dispersing apparatus includes that using a medium and that not using the medium, the objects of the present invention can be effectively attained by processing by means of the dispersing apparatus using a medium.

Examples of dispersing apparatus using a medium include a sand mill, a dyno mill, an attritor and a ball mill, etc. Among the dispersing apparatus using a medium, those which utilize high revolution and can be continuously operated, such as a sand mill and a dyno mill, are the most advantageous for the objects of the present invention because the mixture is continuously processed and sent to a coating machine immediately thereafter.

Various kinds of dispersing media are used for dispersion. Generally, flint, Ottawa sand, steel balls, ceramics, alumina balls, zircon, glass beads, etc., are used. Among these dispersing media, those that are spherically shaped are excellent in the viewpoint of handling property and durability. Further, it is preferred for preventing adhesion of the product that the treatment by the dispersing apparatus is carried out at a temperature of lower than 30° C.

In the case of processing by means of a dispersing apparatus, a more desirable effect such as reduction of the viscosity of a coating solution or improvement of the developing ability can be obtained, when a metal compound such as oxide, hydroxide, silicate, or carbonate of a metal selected from zinc, aluminium, and calcium is used together therewith. A preferred amount of the metal compound used is from 10 to 100 wt%, based on the weight of the acid-treated activated clay.

It is preferred that the above described processing be carried out by wet-dispersion technique in the presence of water, and that the solid content in the dispersion processing be from 10% to 70%, and preferably from 30% to 60% by weight. Further, it is preferred that the volume average particle size of the developer composition after processing be 10$\mu$ or less, and preferably 6$\mu$ or less.

A binder is selected in view of considerations such as adhesion of the recording layer to the base, film strength of the recording layer, etc.

Examples of a water-soluble binder used include water-soluble natural high molecular compounds such as proteins (for example, gelatin, albumin or casein, etc.), celluloses (for example, carboxymethyl cellulose or hydroxyethyl cellulose, etc.) or saccharoses (for example, agar, sodium alginate, carboxymethyl starch or gum arabic, etc.), water-soluble synthetic polymeric compounds such as polyvinyl alcohol, polyvinyl pyrrolidone, polyacrylic acid, polyacrylamide, styrene-butadiene-methacrylic acid copolymer latex, acrylonitrile-butadiene-acrylic acid copolymer latex or styrene-maleic acid anhydride copolymer latex, etc., and other latexes. Among them, carboxy modified latexes are particularly preferred.

The recording sheet of the present invention can be obtained by applying a coating solution to a base such as paper, artificial paper or film, etc., and drying.

As a coating method, it is possible to use conventional methods known by persons skilled in the art, for example, by an air knife coater, a roller coater, a blade coater, a size press coater or a curtain coater, etc., by which a single layer can be formed or plural layers can be formed at the same time.

The amount of coating is generally from 4 to 10 g/m$^2$, preferably from 5 to 9 g/m$^2$, and more preferably from 6 to 8 g/m$^2$, based on the solid content.

The color formers which react with the developer used in the recording sheet of the present invention are not particularly limited. Examples of the color formers include triarylmethane compounds, diphenylmethane compounds, xanthene compounds, thiazine compounds, spiro compounds, and mixtures thereof. However, the effect of the present invention favored in the case of using a triarylmethane compound, and particularly Crystal Violet lactone.

The color formers are applied to the base after they are dissolved in a solvent and encapsulated, or they are dispersed in a solution of a binder.

As the solvent, natural oils and synthetic oils can be used, alone or as a mixture thereof. Examples of the solvent include cotton seed oil, kerosene, paraffin, naphthene oil, alkylated biphenyl, alkylated terphenyl, alkylated naphthalene, diaryl ethane, triaryl methane, and chlorinated paraffin, etc. Examples of the process for producing capsules include a process utilizing coacervation of a hydrophilic colloid sol as described in U.S. Pat. Nos. 2,800,457 and 2,800,458, and an interfacial polymerization process as described in British Pat. Nos. 867,797 and 991,076, etc.

Effects obtained by the present invention are as follows.

First, yellow coloration of the developer sheet is reduced.

Second, deterioration of the developing ability of the developer sheet over a period of time is prevented.

Third, solvent resistance of the developer sheet is improved.

Fourth, water resistance of the developer sheet is improved.

The effects of the recording materials according to the present invention have been acertained e.g., using the following color former sheet.

Hereinafter, all "parts" are by weight.

10 parts of acid-treated hog skin gelatin and 10 parts of gum arabic were dissolved in 400 parts of water at 40° C., and 0.2 part of sulfonated castor oil were added thereto as an emulsifier. Then, 40 parts of a color former oil were dispersed in the resulting solution by emulsification; the color former oil was that obtained by dissolving 4 wt% of Crystal Violet lactone in diisopropylnaphthalene.

When the average particle size of the oil drops became 5 microns, the emulsification was stopped, and water at 40° C. was added to make 900 parts, while stirring was continued. Then, 10 wt% of acetic acid was added to control the pH of the solution to 4.4 to 4.6, by which coacervation was caused. The stirring was further continued for another 20 minutes, then the dispersion was cooled with iced water to gelatinize coacervation films deposited around the oil drops.

When a temperature of the solution became 20° C., 7 parts of 37 wt% formalin were added. When the temperature became 10° C., a 15 wt% aqueous solution of caustic soda was added to adjust the pH to 9. Subsequently, the mixture was heated for 20 minutes with stirring to raise the temperature of the solution to 50° C.

After the resulting microcapsule dispersion was cooled to 30° C., it was applied to paper (40 g/m$^2$) so as to form a layer of 6 g/m$^2$ as the solid content, and dried.

Thus, a microcapsule sheet containing Crystal Violet lactone as the color former was obtained.

EXAMPLE 1

100 parts of acid-treated activated clay, 20 parts of aluminium hydroxide, 10 parts of 2,2-bis(4'-hydroxyphenyl)propane and 3 parts of magnesium oxide were dispersed in 200 parts of water by means of a Kedy mill.

The resulting dispersion was processed by means of a sand mill (Type 32G produced by Igarashi Kikai Co.) at a discharge amount of 300 l/hr to obtain a dispersion having a volume average particle size of 3.6μ. To the resulting dispersion, 2 parts of polypropylene oxide (molecular weight: 400), 50 parts of 10% aqueous solution of oxidized starch, and 20 parts of carboxy modified SBR (styrene-butadiene rubber) latex (solid content: 48%) were added.

The mixture was uniformly stirred and water was added so as to adjust the solid content to 20%. The resulting coating solution was applied to a base paper (40 g/m$^2$) by an air knife coater so as to result in a layer having a solid content of 6.0 g/m$^2$, and dried to obtain a recording sheet.

EXAMPLE 2

2 parts of polyethylene oxide (molecular weight: 600) and the same binder as in Example 1 were added to the same dispersion as in Example 1, and the resulting coating solution was applied by the same way as in Example 1 to obtain a recording sheet.

COMPARATIVE EXAMPLE 1

To a dispersion obtained by the same procedure as in Example 1, except that polypropylene oxide was not used, the same binder as in Example 1 was added, and application was carried out by the same way as in Example 1 to obtain a recording sheet.

COMPARATIVE EXAMPLE 2

A dispersion was obtained by the same procedure as in Example 1 except that 10 parts of 2,2-bis(4'-hydroxyphenyl)propane were not used. Then, the same binder as in Example 1 was added, and application was carried out by the same way as in Example 1 to obtain a recording sheet.

Tests for Comparison

Tests for comparison of the resulting recording sheets in the Examples 1 and 2 and Comparative Examples 1 and 2 were carried out as follows. The microcapsule sheet used was the above described microcapsule sheet containing Crystal Violet lactone.

(i) Comparison of Coloration

After the recording sheets obtained in the Examples and Comparative Examples were subjected to (a) exposing to sunlight for 2 weeks, or (b) standing in a room not exposed to direct sunlight 2 months, reflectivities (440 nm, Hitachi Color Analyzer: Type-307) were measured. In this test, smaller values indicate greater yellow coloration.

(ii) Comparison of Developing Ability

The microcapsule sheet was put on the recording sheets obtained in the Examples and Comparative Examples. After typewriting, color densities (610 nm, Hitachi Color Analyzer: Type-307) after 1 day were measured.

(iii) Comparison of Developing Ability over a Period of Time

The recording sheets obtained in the Examples and Comparative Examples were allowed to stand in a room of 60 luxes for 7 days. After typewriting in the same was as in (ii), color densities after 1 additional day were measured.

(iv) Comparison of Solvent Resistance

Durability of the color former in (ii) to dioctylphthalate was visually observed. The samples were coated with dioctylphthalate using a bar-coating machine.

(v) Comparison of Water Resistance

Degree of fading in the case of wetting the color former in (ii) with water was visually observed. The samples were wetted by coating a small amount of water using a bar-coating machine.

Results of the tests are shown in Table 1.

TABLE 1

| Recording Sheet | Yellow Coloration (440 nm reflectivity) Just after Coating | After Exposing to Sunlight for 2 Weeks | After Standing in Room for 2 Months | Developing Ability (density at 610 nm) | Change of Developing Ability over a Period of Time (density at 610 nm) | Solvent Resistance | Water Resistance |
|---|---|---|---|---|---|---|---|
| Example 1 | 86.4 | 80.0 | 76.7 | 0.52 | 0.48 | Good | Good |
| Example 2 | 86.2 | 79.5 | 76.3 | 0.52 | 0.47 | Good | Good |
| Comparative Example 1 | 85.4 | 73.7 | 68.2 | 0.52 | 0.46 | Good | Good |
| Comparative Example 2 | 86.0 | 80.0 | 76.5 | 0.50 | 0.38 | Inferior | Inferior |

It is understood from Table 1 that recording sheets of the present invention result in less yellow coloration, a smaller change of developing ability over a period of time, and have excellent durability as compared with the comparative recording sheets.

EXAMPLE 3

100 parts of acid-treated activated clay, 20 parts of aluminium hydroxide, 10 parts of p-phenylphenol resin and 3 parts of magnesium oxide were dispersed in 200 parts of water by means of a Kedy mill.

The resulting dispersion was processed by means of a sand mill (Type 32G produced by Igarashi Kikai Co.) at a discharge amount of 300 l/hr to obtain a dispersion having a volume average particle size of 3.6$\mu$. To the resulting dispersion, 2 parts of polypropylene oxide (molecular weight: 400), 50 parts of a 10% aqueous solution of oxidized starch and 20 parts of carboxy modified SBR latex (solid content: 48%) were added.

The mixture was uniformly stirred and water was added so as to adjust the solid content to 20%. The resulting coating solution was applied to a base paper (40 g/m$^2$) by an air knife coater so as to result in a layer having a solid content of 6.0 g/m$^2$, and dried to obtain a recording sheet.

EXAMPLE 4

2 parts of polyethylene oxide (molecular weight: 600) and the same binder as in Example 3 were added to the same dispersion as in Example 3, and the resulting coating solution was applied by the same way as in Example 3 to obtain a recording sheet.

COMPARATIVE EXAMPLE 3

To a dispersion obtained by the same procedure as in Example 3 except that polypropylene oxide was not used, the same binder as in Example 3 was added, and application was carried out by the same way as in Example 3 to obtain a recording sheet.

COMPARATIVE EXAMPLE 4

A dispersion was obtained by the same procedure as in Example 3 except that 10 parts of p-phenylphenol resin were not used. Then the same binder as in Example 3 was added, and application was carried out by the same way as in Example 3 to obtain a recording sheet.

Tests for comparison of the resulting recording sheets in Examples 3 and 4 and Comparative Examples 3 and 4 were carried out in the same manner as described above except that the exposing time of 1 week in step (a) was used instead of 2 weeks. The results are shown in Table 2.

TABLE 2

| Recording Sheet | Yellow Coloration (440 nm reflectivity) Just after Coating | After Exposing to Sunlight for 1 Week | After Standing in Room for 2 Months | Developing Ability (density at 610 nm) | Change of Developing Ability over a Period of Time (density at 610 nm) | Solvent Resistance | Water Resistance |
|---|---|---|---|---|---|---|---|
| Example 3 | 86.3 | 78.1 | 76.0 | 0.52 | 0.49 | Good | Good |
| Example 4 | 86.1 | 78.0 | 75.8 | 0.52 | 0.48 | Good | Good |
| Comparative Example 3 | 85.0 | 65.0 | 68.2 | 0.52 | 0.46 | Good | Good |
| Comparative Example 4 | 86.2 | 78.9 | 75.5 | 0.50 | 0.38 | Inferior | Inferior |

It is understood from Table 2 that recording sheets of the present invention cause less yellow coloration and a smaller change of developing ability over a period of time and have excellent durability as compared with the recording sheets for comparison.

While the invention has been described in detail and with reference to specific embodiments thereof, it will be apparent to one skilled in the art that various changes and modifications can be made therein without departing from the spirit and scope thereof.

What is claimed is:

1. A recording material comprising a base and a developer composition comprising (1) a phenolic compound selected from a bisphenol compound and a phenolic resin, (2) acid-treated activated clay, and (3) a polyalkylene oxide compound in an amount of from 0.2 to 5 wt%, based on the weight of the acid-treated activated clay, applied to said base.

2. A recording material as in claim 1, wherein the phenolic compound is a bisphenol compound which does not contain sterically hindering substituents in positions adjacent to the phenolic hydroxyl groups.

3. A recording material as in claim 2, wherein the bisphenol compound is represented by formula (I)

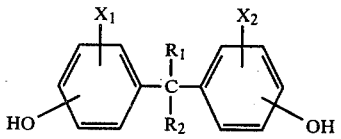

(I)

wherein $R_1$ and $R_2$ can each represent a hydrogen atom or an alkyl group having 16 or less carbon atoms, and $X_1$ and $X_2$ can each represent a hydrogen atom, an alkyl group, an alkenyl group, a carboxyalkyl group, an aralkyl group, a halogen atom, a nitro group, an amino group, a hydroxyl group, or a carboxyl group.

4. A recording material as in claim 3, wherein the alkylene group linking the phenolic nuclei in formula (I) has 8 or less carbon atoms.

5. A recording material as in claim 1, wherein the phenolic compound is a phenolic resin selected from the group consisting of p-phenylphenol resin, p-tert-butylphenol resin, p-octylphenol resin, p-nonylphenol resin, p-chlorophenol resin, p-cumylphenol resin and metal salts thereof.

6. A recording material as in claim 5, wherein the phenolic resin is p-phenylphenol resin.

7. A recording material as in claim 1, 2, 3, 4, 5, or 6, wherein the phenolic compound is used in an amount of from 2 to 50 wt%, based on the weight of the acid-treated activated clay.

8. A recording material as in claim 7, wherein the phenolic compound is used in an amount of from 5 to 30 wt%, based on the weight of the acid-treated activated clay.

9. A recording material as in claim 1, wherein the polyalkylene oxide compound is formed from an alkylene oxide having from 2 to 8 carbon atoms.

10. A recording material as in claim 1, wherein the polyalkylene oxide compound is formed from ethylene oxide or propylene oxide.

11. A recording material as in claim 1, wherein the polyalkylene oxide compound has a molecular weight of from 200 to 5,000.

12. A recording material as in claim 1, wherein the polyalkylene oxide compound has a molecular weight of from 300 to 1,000.

13. A recording material as in claim 1, wherein the polyalkylene oxide compound is added in an amount from 1 to 3 wt%, based on the weight of the acid-treated activated clay.

14. A recording material as in claim 1, wherein an oxide, hydroxide, silicate or carbonate of a metal selected from zinc, aluminum, and calcium is blended with the developer composition in an amount of from 10 to 100 wt%, based on the weight of the acid-treated activated clay.

15. A recording material as in claim 1, prepared by a wet-dispersion technique in the presence of water wherein the solid content in the dispersion processing is from 10% to 70% by weight.

16. A recording material as in claim 1, prepared by a wet-dispersion technique in the presence of water, wherein the solid content in the dispersion processing is from 30% to 60% by weight.

17. A recording material as in claim 1, wherein the volume average particle size of the developer composition is 10μ or less.

18. A recording material as in claim 1, wherein the volume average particle size of the developer composition is 6μ or less.

19. A recording material as in claim 1, wherein the developer composition is coated on the base in an amount of from 4 to 10 g/m$^2$.

20. A recording material as in claim 1, wherein the developer composition is coated on the base in an amount of from 5 to 9 g/m$^2$.

21. A recording material as in claim 1, wherein the developer composition is coated on the base in an amount of from 6 to 8 g/m$^2$.

* * * * *